US009290009B2

(12) United States Patent
Govorkov et al.

(10) Patent No.: US 9,290,009 B2
(45) **Date of Patent: *Mar. 22, 2016**

(54) LASER LABEL-PRINTER

(71) Applicant: Coherent, Inc., Santa Clara, CA (US)

(72) Inventors: Sergei Govorkov, Los Altos, CA (US); John H. Jerman, Palo Alto, CA (US)

(73) Assignee: Coherent, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/614,205

(22) Filed: Feb. 4, 2015

(65) Prior Publication Data

US 2015/0145942 A1 May 28, 2015

Related U.S. Application Data

(62) Division of application No. 13/897,011, filed on May 17, 2013, now Pat. No. 8,988,477.

(51) Int. Cl.

| | |
|---|---|
| ***B41J 2/435*** | (2006.01) |
| ***B41J 2/47*** | (2006.01) |
| ***B41J 2/44*** | (2006.01) |
| ***B41J 3/407*** | (2006.01) |

(52) U.S. Cl.
CPC .. *B41J 2/442* (2013.01); *B41J 2/47* (2013.01); *B41J 3/4075* (2013.01)

(58) Field of Classification Search
CPC ..... B41J 2/435; B41J 2/442; B41J 2/47; G03G 15/043; G03G 15/0435
USPC ..... 347/224, 225, 229, 230, 234–237, 347/241–250, 256–260, 263
See application file for complete search history.

(56) References Cited

U.S. PATENT DOCUMENTS

| | | | | |
|---|---|---|---|---|
| 4,990,771 | A * | 2/1991 | Minoura et al. | 250/236 |
| 5,043,553 | A * | 8/1991 | Corfe et al. | 219/121.7 |
| 6,489,985 | B1 * | 12/2002 | Brodsky et al. | 347/247 |
| 7,098,448 | B2 * | 8/2006 | Inoue et al. | 250/234 |
| 7,499,185 | B2 | 3/2009 | Nomaru et al. | |
| 7,952,602 | B2 | 5/2011 | Govorkov et al. | |
| 7,952,603 | B2 | 5/2011 | Govorkov et al. | |
| 7,961,370 | B2 | 6/2011 | Jerman | |
| 8,988,477 | B2 * | 3/2015 | Govorkov et al. | 347/241 |
| 2005/0008390 | A1 | 1/2005 | Jang et al. | |
| 2010/0078857 | A1 | 4/2010 | Govorkov et al. | |
| 2010/0079572 | A1 | 4/2010 | Govorkov et al. | |
| 2011/0164104 | A1 * | 7/2011 | Govorkov et al. | 347/241 |
| 2012/0268548 | A1 | 10/2012 | Jerman et al. | |
| 2013/0002792 | A1 * | 1/2013 | Sakurai | 347/224 |

FOREIGN PATENT DOCUMENTS

| | | | |
|---|---|---|---|
| JP | 3-239598 | A | 10/1991 |
| JP | 2000-168143 | A | 6/2000 |

OTHER PUBLICATIONS

Non-Final Office Action received for U.S. Appl. No. 13/897,011, mailed on Jun. 20, 2014, 10 pages.
Notice of Allowance received for U.S. Appl. No. 13/897,011, mailed on Oct. 31, 2014, 9 pages.
International Search Report and Written Opinion received for PCT Patent Application No. PCT/US2014/038278, mailed on Aug. 4, 2014, 14 pages.

* cited by examiner

*Primary Examiner* — Hai C Pham
(74) *Attorney, Agent, or Firm* — Morrison & Foerster LLP

(57) ABSTRACT

A laser label printer for use with a laser markable medium includes a laser-diode fiber-coupled to an optical train, which includes a focusing lens for focusing the radiation on the medium. The focusing lens is traversed across the medium, with incremental motion of the medium between traverses, for line by line printing of the label. The printer includes a feature for protecting the focusing lens from contamination, and self-diagnostic and adjustment features.

13 Claims, 4 Drawing Sheets

LASER LABEL-PRINTER

PRIORITY

This application is a divisional of U.S. Ser. No. 13/897,011, filed May 17, 2013, the disclosure of which is incorporated herein by reference in its entirety.

TECHNICAL FIELD OF THE INVENTION

The present invention relates in general to laser-marking systems. The invention relates in particular to laser-marking systems wherein the marking laser is a diode-laser.

DISCUSSION OF BACKGROUND ART

Laser-marking systems are now in common use for marking materials such as metals, glass, wood, and plastic. Lasers used in such marking systems include diode-pumped solid-state lasers, fiber-lasers, and carbon dioxide ($CO_2$) lasers. Typically a beam from whatever laser is used in the system is steered by a two-axis galvanometer and focused by f-theta optics onto a surface of an object being marked.

Special materials have been developed, and are commercially available, for accepting laser-radiation to allow high-speed, high-volume, writing of labels with a laser marking system. One such material is "Laser Markable Label Material 7847" available from 3M Corporation of Minneapolis, Minnesota. This material is a three-layer polymer material having an outer layer of a black material to facilitate absorption of laser-radiation. Beneath the black material is a layer of white material which is exposed when the black material is ablated away by laser-radiation. The black and white material layers are backed by an adhesive layer. These three layers are supported on a carrier from which an adhesive backed label can be peeled when complete. The white material can be laser-cut to define the bounds of the label and allow such peeling. Other materials include black-anodized metal (aluminum) foil, organic materials used in electronics packaging and printed circuit boards, and white paper impregnated with a dye having an absorption band in the near infrared region of the electromagnetic spectrum for absorbing NIR laser-radiation. These materials are conveniently supplied in the form of rolls of tape, so that large numbers of separate labels can be generated without having to reload material in the label maker.

Even the least expensive laser-marking system designed for these label materials has a cost at least about two orders of magnitude greater than a computer peripheral paper-label printer such as an inkjet printer. Because of this, such a system is beyond the means of the majority of smaller industrial or commercial users. This is somewhat unfortunate, as these laser-markable materials have significant advantages over inkjet-printed labels in terms of ruggedness and durability. Accordingly, there is a need for a significant reduction in the cost of systems for printing such laser-markable materials.

SUMMARY OF THE INVENTION

The present invention is directed to apparatus for printing a laser markable medium. In one aspect, apparatus in accordance with the present invention comprises a sheet of the medium in a printing plane, the sheet having a width. The apparatus includes a collimating module held in a fixed position, the collimating module including a collimating lens. The apparatus further includes a focusing module including a turning mirror and a focusing lens, the focusing module being reciprocally translatable along a carriage axis about parallel to the printing plane. An elongated window is provided between the focusing module and the printing plane, the window extending at least across the width of the sheet of the medium. A source of laser-radiation is provided and an optical fiber is provided for transporting the laser-radiation from the source thereof to the collimating module and delivering the laser-radiation from a distal end thereof in a diverging beam to the collimating lens. The collimating lens is arranged to collimate the diverging beam from the optical fiber and direct the collimated beam to the focusing module. The turning minor directs the collimated beam to the focusing lens, and the focusing lens focuses the collimated beam through the window onto the sheet at a focal distance from the focusing lens for printing on the sheet. The window protects the focusing lens from contamination from by-products of the printing by the focused beam. A detector is arranged to provide a signal representative of power of the focused beam on the sheet. The signal is delivered to an electronic module cooperative with the laser-radiation source for maintaining power of the focused beam on the sheet about constant as the window becomes contaminated by the by-products of the printing by the focused beam.

BRIEF DESCRIPTION OF THE DRAWINGS

The accompanying drawings, which are incorporated in and constitute a part of the specification, schematically illustrate a preferred embodiment of the present invention, and together with the general description given above and the detailed description of the preferred embodiment given below, serve to explain principles of the present invention.

DETAILED DESCRIPTION OF THE INVENTION

Figure 1:
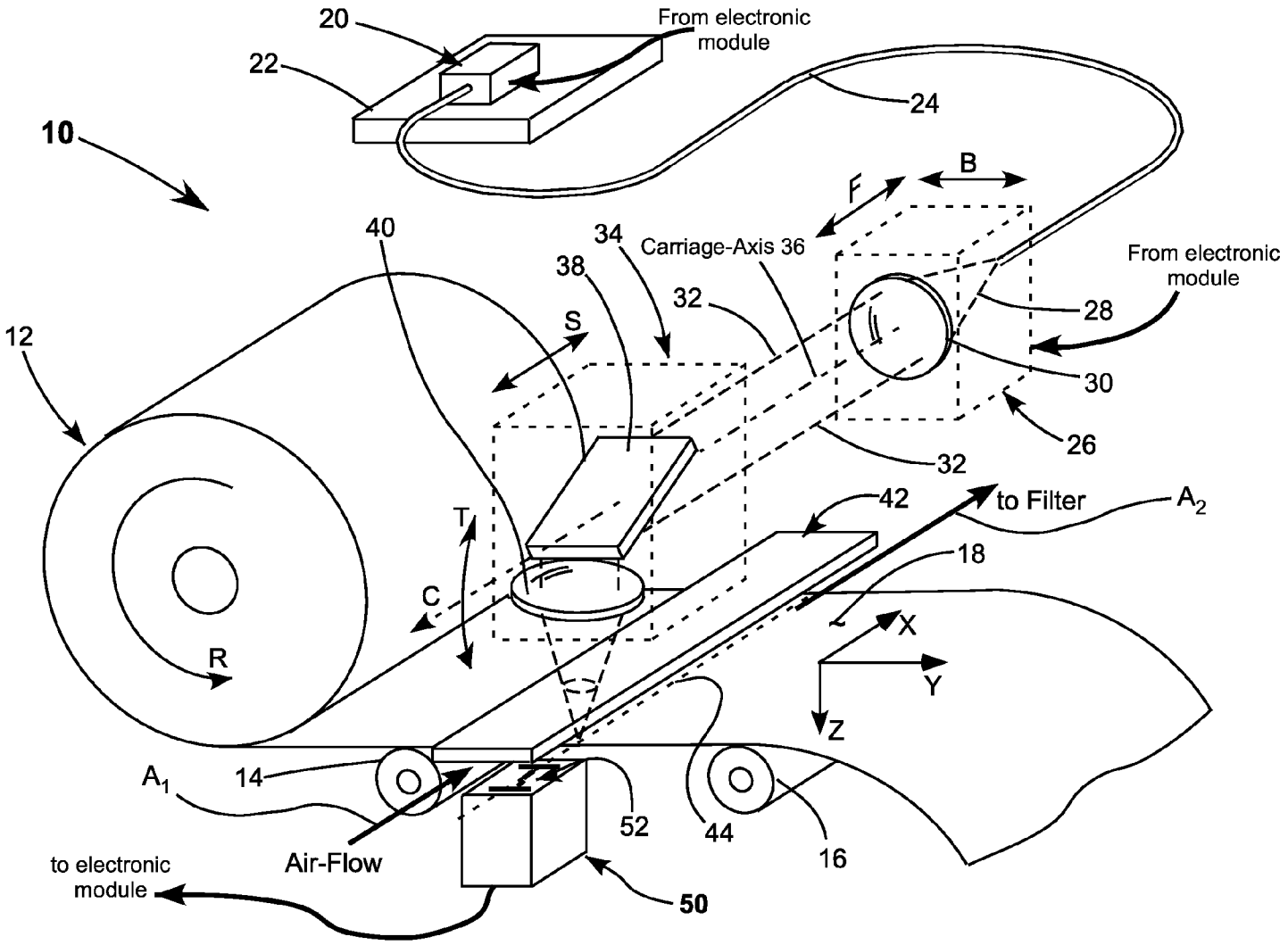
FIG. 1 is a three-dimensional view schematically illustrating one preferred embodiment of a laser label-printer in accordance with the present invention, including a diode-laser source transmitting laser-radiation to a stationary collimating module including a collimating lens with collimated radiation from the lens directed to a carriage mounted focusing module for reciprocally translating, along a carriage-axis, a focused beam of laser-radiation on a medium being printed in a printing plane and a diagnostic module in the printing plane arranged to analyze the focused beam after one or more transits of the carriage.

Referring now to the drawings, wherein like components are designated by like reference numerals, FIG. 1 schematically illustrates a preferred embodiment 10 of a laser label-printer in accordance with the present invention. Printer 10 includes a roll 12 of a laser-markable medium such as the type discussed above. Roll 12 is rotatable in a direct indicated by arrow R for feeding material through the printer in the Y-axis direction of a Cartesian X-, Y- and Z-axis system depicted in the drawing. A medium-transport mechanism including rollers 14 and 16, feeds medium being printed, taught, in a medium-plane or printing-plane 18 parallel to the X-Y plane defined by the Cartesian axis system.

Laser-radiation here is provided by fiber-coupled laser-diode module 20 mounted on a heat-sink 22. A preferred laser-diode module is a telecom-grade, 10 Watt (W) class, environmentally sealed laser-diode. The maximum amount of dissipated heat of roughly 10 W makes it possible to use a very simple cooling scheme, such as a micro-fan (not shown) blowing air onto the heat-sink. The heat sink can be a simple aluminum plate.

Laser-diode 20 may be driven by a simple electronic driver operating from any 24 Volt DC, computer style, AC-DC adaptor. Current driving the laser-diode is modulated by instructions from an electronic module, not explicitly shown with the modulation corresponding to pixels of an image or text to be printed, line-by-line. The electronic module has other functions described further hereinbelow. As from the description of the inventive printer presented herein one skilled in the art could provide and program an electronic module with the required functionality without any significant challenge, no specific arrangement or circuitry of the module is described or depicted herein.

Continuing with reference to FIG. 1, laser-radiation from laser-diode module 20 is transported by an optical fiber 24 to a nominally stationary collimating-module 26. The term nominally stationary as used here allows for some position adjustment indicated by arrows F and B, responsive to instructions from the electronic module. The purpose of these adjustments is discussed further hereinbelow. Collimating module 26 includes a lens 30 which converts the diverging beam 28 of the laser-radiation emitted from optical fiber 24 into a collimated beam 32.

Collimated beam 32 is directed to a focusing-module 34 mounted on a carriage (not shown) which scans the focusing-module reciprocally, as indicated by double arrow S, along a carriage-axis 36 parallel to the X-axis in the Cartesian axis system of FIG. 1. The carriage axis is additionally indicated by arrow C. Focusing-module 34 includes a plane turning-mirror 38 which directs collimated beam 32 downward, in the z-axis direction of the Cartesian system, to a focusing lens 40. Lens 40 focuses the collimated beam through an elongated window 42 onto the medium in the medium-plane 18. One traverse of the carriage ablates a line of image or text pixels in the medium along a beam path 44. Repeated traverses of the focusing module with incremental motion of the medium in the Y-axis direction therebetween are used to print text or image content of a label.

A preferred carriage mechanism is that of a commercially available ink-jet printer which provides for translating the carriage across the medium being printed with high precision equivalent to up to 2400 dpi resolution. One example such a carriage can be found in a LX900 Inkjet Label Printer available from Primera Technology Inc. of Plymouth, Minn. Such a carriage can be translated at speeds of several meters per second.

In order to preserve the inherent robustness of such a carriage mechanism in the inventive printer, the number of optics on the carriage was minimized to minimize weight on the carriage. In this preferred embodiment only mirror 38 and lens 40 are mounted on the carriage. Minimizing the weight allows, inter alia, for faster decelerating and accelerating (turn around) at the end of a traverse, faster traverse speeds for faster printing, and reduced wear of the carriage-drive mechanism.

In order to further minimize weight, lens 40 is preferably a molded plastic lens, and mirror 38 is made from a silicon wafer having a thickness of about 1 millimeter, and coated on the reflecting surface with a highly reflective multilayer dielectric coating. This makes such minor inexpensive and very light. However, in a typical aperture size of mirror, for example, 25 millimeters (mm) by 30 mm the thickness-to-aperture ratio is far less than a 1:5 generally regarded as necessary to make the minor resistant to bending. To compensate for this a light but stiff metal plate employing a three-point support can be used. The support points can be steel or glass balls bonded to the plate, with the silicon mirror bonded to the balls using a flexible adhesive such as silicone RTV.

Collimating lens 30 and focusing lens 40 form an optical train which is essentially an imaging system with close to unity magnification. In the case of collimating lens 30 it was found that a simple plano-convex lens provided adequate collimation. However, for focusing lens 40 it was found preferable to use an aberration corrected lens for optimum focused spot intensity corresponding to print contrast. Examples of aberration corrected lenses are aspheric lenses, and lenses made from graded index glass. Injection molded (plastic) lenses can be made aspheric with sufficient accuracy, are extremely cost efficient in volume production, and are relatively light (compared to glass) as discussed above. Molded lenses can be made of special grades of glass by compression molding. A glass lens could be selected, for example, particularly if a higher index of refraction than is available in plastic were required for the lens.

Continuing again with reference to FIG. 1, window 42 is a particularly important component of printer 10. The purpose of the window is to protect focusing lens 40 from smoke and debris generated in the process of laser printing. This smoke and debris is ejected at high speed towards the lens. Without window 42, this smoke and debris would contaminate the lens to a point where replacement or cleaning must be carried out. As the lens is precisely aligned, such cleaning or replacement would need to be carried out my trained personnel, probably putting the printer out of service for some time.

Window 42 prevents smoke and debris from reaching lens 40, extending the useful life of the lens indefinitely. Certainly the window itself will become contaminated by the smoke and debris, but as the window does not require precise alignment, replacement or cleaning can be done in place by an end user of the printer. Replacing the window does not require alignment and the cost of it is minimal. Such replacement can be done in the field by the end user. The window can be manufactured out of plastic, by injection molding or out of glass by cleaving large glass panels. Either approach is low in cost so that the window can be a disposable part. Replacement would require no more skill or effort than replacing an ink jet cartridge in a laser printer or a toner cartridge in a conventional laser printer.

One means of slowing contamination of window 42 is to blow air under the window across the beam direction as indicated in FIG. 1 by arrow $A_1$. This can be done with a simple air-pump (not shown). The air movement must be relatively gentle to avoid disturbing the flatness of the medium being printed. Exhaust air contaminated with fumes is preferably passed through a set of filters (not shown) to remove particles and chemicals.

Whatever air-flow method is used, window 42 will become increasingly contaminated with increasing operating hours of the printer. In order to maintain a consistent print quality between window replacements, it is necessary to provide dynamic compensation for the increasing contamination and an attendant loss of transmission of the window.

A preferred means of providing such compensation is to locate a beam-diagnostic module 50 close to the medium being printed for measuring power in the focused laser beam. Module 50 has a diagnostic plate 52 with at least one aperture therein (not explicitly designated in FIG. 1) in optical communication with a photo-detector (not shown in FIG. 1) within the module. Diagnostic plate 52 is positioned beyond the side edge of the medium and is preferably in the same plane as the medium-plane 18.

The photo-detector provides a signal representative of power on diagnostic plate 52 and that signal is transmitted to the electronics module of printer 10. In order for this power on the diagnostic plate to be representative of power on the medium, window 42 is extended beyond the edge of the medium and covers the diagnostic plate as depicted in FIG. 1, and is subject to about the same contamination by smoke and debris as the remainder of the window over the medium.

In operation, the power-representative signal from the diagnostic module can be sampled after every traverse, or some predetermined plurality of traverses, of the focusing-module. The sampled signal can be used by the electronic module in a closed loop to increase the laser-diode output power to keep power on the diagnostic module constant as contamination builds on the window. When the laser-diode power has been increased to some predetermined level, the electronics module can provide a warning signal, for example, by turning on an alarm light, that a replacement of window 42 is required. Other useful functions of diagnostic module 50 are described further hereinbelow.

Figure 1A:
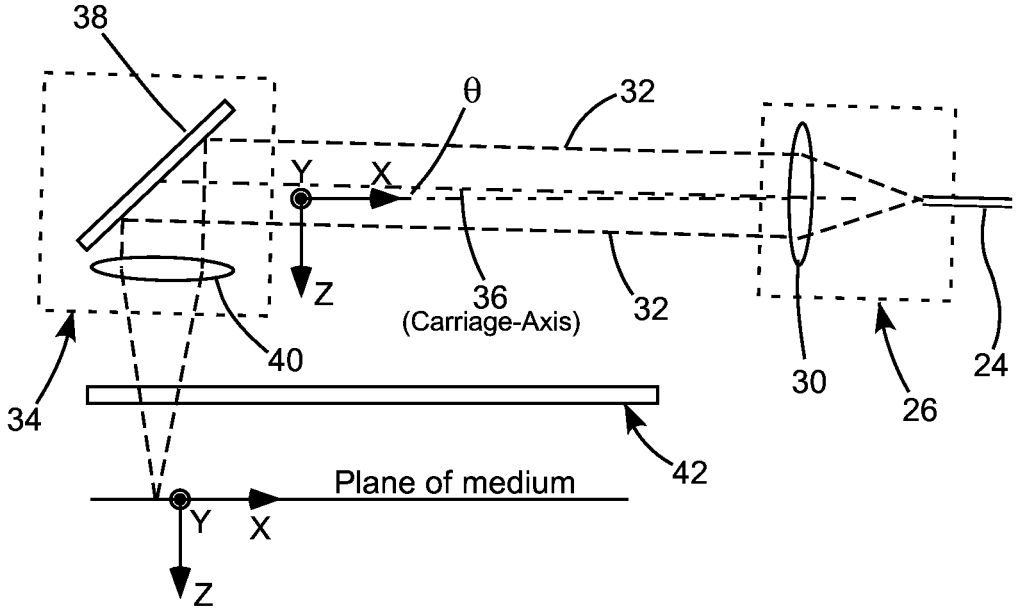
FIG. 1A schematically illustrates an inclination of the carriage axis with respect to the printing plane for compensating for focal-distance changes resulting from variation of spacing of the collimator and focusing modules.

Referring now to FIG. 1A, and with continuing reference to FIG. 1, in practice collimating lens 30 may provide less than perfect collimation, in which case there may be a slight, but significant, progressive change of focal distance of lens 40 as the optical separation of lenses 30 and 40 changes during traversing of the focusing module. If this is not compensated, there could be a variation of print contrast across the medium.

A reason for the focus shift is the beam has a certain degree of optical coherence the beam. Such a beam cannot be collimated in the geometrical optics sense, meaning the beam always has some divergence due to diffraction. Ray-tracing a single transverse mode (Gaussian), fully coherent beam indicates that that the position of the beam-waist is close to the focal plane (not specifically indicated) of lens 40, but not exactly at the focal plane. The distance between lens 30 and lens 40, may vary between about 10 mm and 100 mm as a result of the traversing. This can cause deviations in the focal plane position of a few millimeters.

For a highly incoherent beam, a geometrical optics approximation is a lot more accurate, and a simple one to one imaging holds true. In that case, the minimal spot size is always in the focal plane of lens 40, independent of the distance between lenses 30 and 40. In the inventive printer the beam is somewhere between partially coherent and completely incoherent, meaning that the output of the fiber is a collection of multitude of independent coherent beams. The focusing properties, and thus the peak intensity in the focal spot, are partially governed by the diffractive propagation laws and result in the effective focus shift.

One means of compensating for this is to selectively tilt carriage axis 36 with respect to the medium plane (the X-Y plane of the Cartesian axis system) as indicated in the drawings by double arrow T (see FIG. 1). In most cases, the angle θ (see FIG. 1A) between the carriage-axis and the X-Y plane (medium-plane) will not be greater than one degree. The angle will be as indicated in the drawing, i.e., compensating for a longer focal distance the greater the spacing between lenses 30 and 40.

Figure 2A:
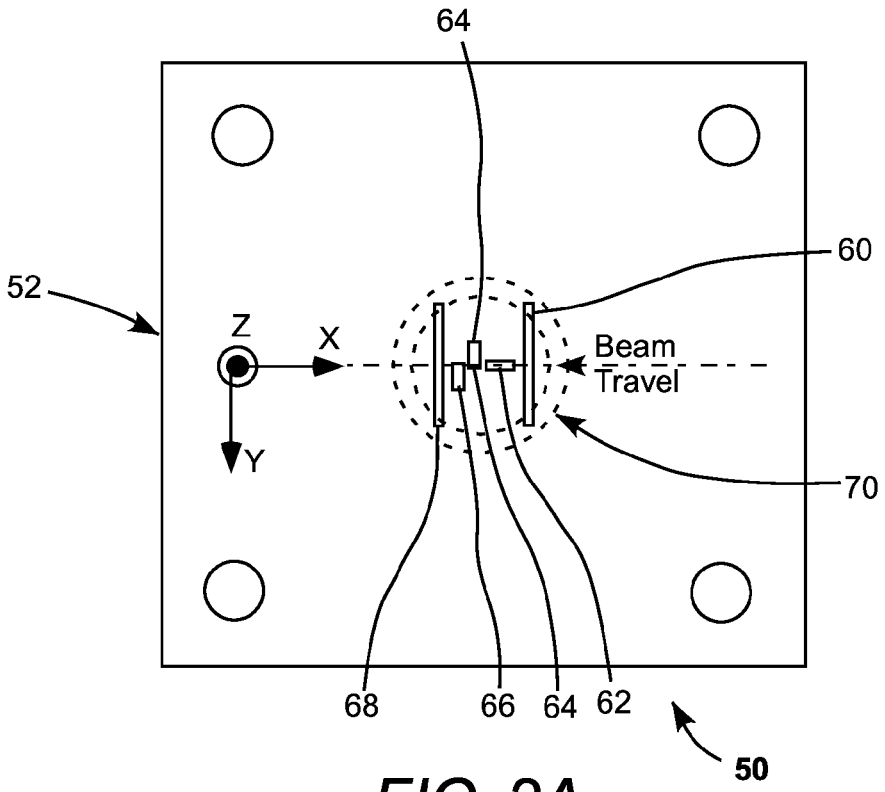
FIG. 2A is a plan view from above schematically illustrating one preferred arrangement of diagnostic apertures in the diagnostic module of FIG. 1.
Figure 2B:
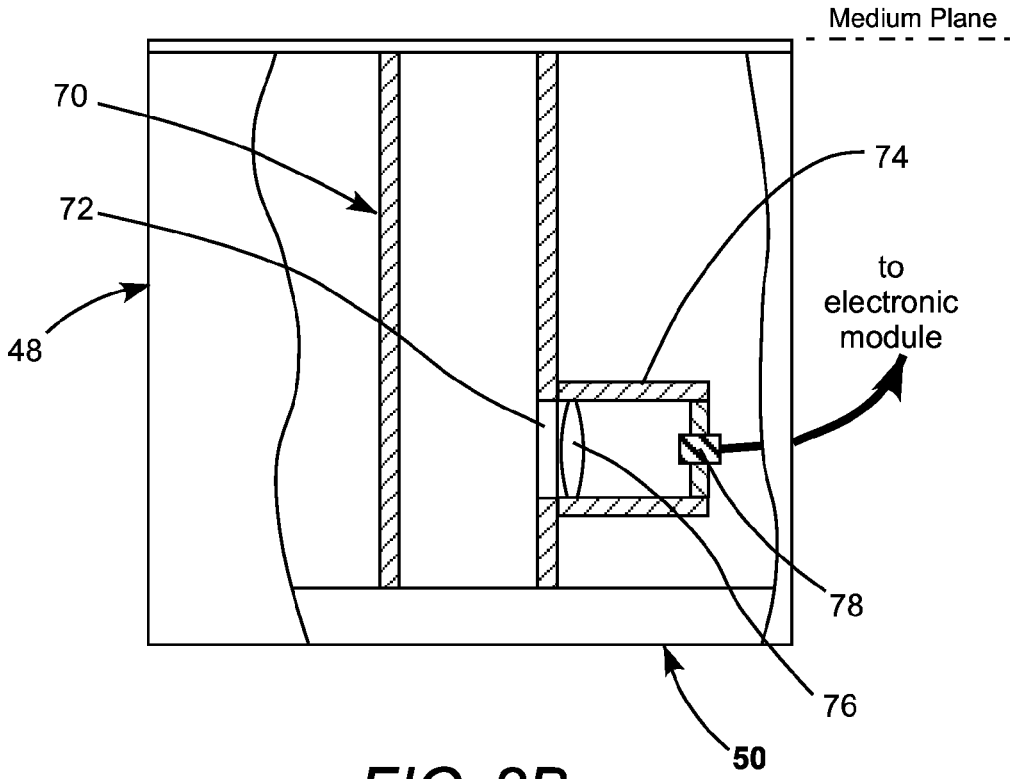
FIG. 2B is a cut-away elevation view partly in cross-section schematically indication an integrating cylinder and photodetector in the diagnostic module of FIG. 2A.

A detailed description of a preferred construction and alternate uses of diagnostic module 50 of FIG. 1 is next presented with reference to FIG. 2A and FIG. 2B, and with continuing reference to FIG. 1. FIG. 2A is a plan view from above schematically illustrating one preferred arrangement of diagnostic plate 52 in diagnostic module 50. Plate 52 includes a plurality of etched slots arranged in the beam-travel path. In body 48 (see FIG. 2B) of module 50 there is a collecting cylinder 70 (depicted in outline in FIG. 2A) below the plurality of slots which collects laser-radiation passing through any one of the slots.

Tube 70 functions as an "integrating cylinder" for the radiation. A sample of radiation integrated in cylinder 70 is sampled by a sampling cylinder 74 though an aperture 72 in cylinder 70. A lens 76 inside cylinder 74 focuses the sampled radiation onto a high speed photodetector 78, which provides an electronic signal representative of the radiation passing through any particular one of the slots in plate 52. In any one traverse of the focused beam over the slots, detector 78 delivers a sequence of five signals to the electronic module for processing and response.

In plate 52, slot 60 has a length (perpendicular to the beam travel) greater than the focused beam diameter and a width on the order of or somewhat less than the focused beam diameter. This slot gives rise to the first of the five signals and provides a representation of how precisely the beam is focused.

In particular, a beam that is tightly focused near the surface of plate 52 will produce a signal from the sensing photodetector having a faster rise and fall time as the beam transits the slot than a beam that is less tightly focused. In addition, any change in the characteristic rise and fall time is an indication of a misalignment or defocus of the optical beam train. Slot 62 has a length and width greater than the beam diameter and gives rise to the second of the five signals the peak magnitude of which is representative of the power in the beam.

Slots 64 and 66 each have a width and length greater than the beam diameter, but are misaligned on opposite sides of beam-travel path and encroach into the beam travel-path by less than the beam diameter. These slots provide the third and fourth of the five signals, and the electronic module uses the ratio of these signals as a measure of the amount and direction of beam misalignment. By way of example if the ratio is unity, then the beam is perfectly aligned. The ratio is greater than one the beam is misaligned to one side of the path. If the ratio is less than one, the beam is misaligned to the opposite side of the path.

Slot 68 has the dimensions of slot 60 and can be used as a verification of the velocity of the beam across plate 52. Alternative configurations of the slot geometry can include tapered slots to give an additional measure of the position of the beam away from the desired beam path.

Continuing now with particular reference again to FIG. 1, it is described above how the power-representative (second) signal discussed above is used by the electronic module to provide beam-spot power consistency and an indication that replacement of window 42 is required. Provided that beam 32 is not perfectly collimated, the focus-representative-signal could be used together with a cooperative translation device (not shown), in the apparatus of FIG. 1, to move collimating module 26 thereof in directions indicated by double arrow F (in the translation direction of the focusing module) for maintaining optimum focus. Similarly, the alignment-representative signal ratio could be used (whatever the collimation state of beam 32) to move collimating module 26 in directions indicated by double arrow B for maintaining about constant alignment of beam-translation path 44 on the medium. Those skilled in the art may devise other mechanisms and signals for adjusting beam-focus and beam-alignment without departing from the spirit and scope of the present invention.

In the interest of reducing printer cost, it may be possible to dispense with the above-described automatic focus and beam alignment adjustment, however, a measurement of laser-radiation power through window 42 (and corresponding adjustment of power from laser-diode 20) is still important for maintaining a consistent print quality. A description of alternate arrangements for providing such measurement is set forth below with reference to FIG. 3.

Figure 3:
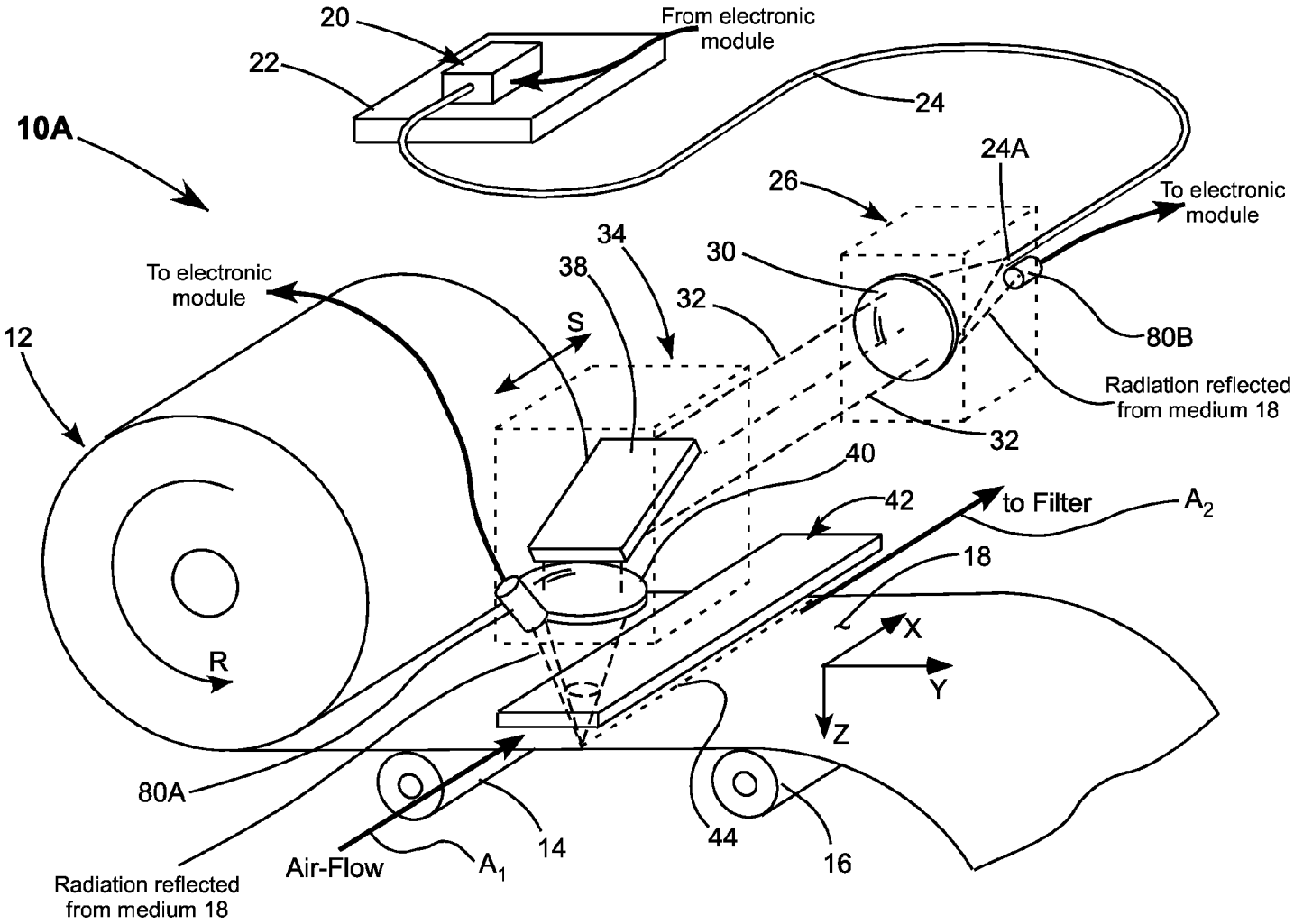
FIG. 3 is a three-dimensional view schematically illustrating another preferred embodiment of a laser label-printer in accordance with the present invention, similar to the embodiment of FIG. 1, but wherein the diagnostic module is replaced by a photodetector arranged to measure laser-radiation scattered by the medium being printed.

FIG. 3 schematically illustrates another preferred embodiment 10A of a laser label-printer in accordance with the present invention, similar to the embodiment of FIG. 1, but wherein diagnostic module 50 is replaced by a photodetector 80, arranged to measure laser-radiation scattered or reflected by the medium being printed as a measure of radiation power through window 42 to be supplied to the electronic module. In FIG. 3, photodetector 80 is depicted in two possible locations. One location is in carriage-mounted focusing module 34, here, adjacent focusing lens 40. This detector is designated detector 80A. The other location is in collimating module 26, immediately adjacent tip (distal end) 24A of fiber 24. Here, the photodetector is designated photodetector 80B.

It is believed, without being limited to a particular theory, that photodetector 80B, near the fiber tip, will have a signal that is best correlated to "reflectance", however diffuse, from the medium. Photodetector 80A on the carriage-mounted focusing module (receiving more "scattered" light) would be influenced more by radiation scattered from the "smoke cloud" arising from the ablating spot.

In a prototype version of the inventive printer, wherein laser-diode 20 delivered infrared (IR) radiation having a wavelength of about 980 nm, it was possible to see a visible light glow during the ablation process, presumably from very hot particles of the medium ejected from the surface of the medium. It is possible that a ratio between the visible and IR could provide a determinant for detecting if the ablation process is actually occurring. There may be at least two uses of this visible signal. One can be to judge if the window contamination increased to the level where diode power needs to be increased or the window changed. Another, can be to dynamically adjust the ablating pulse length so as to terminate the IR power once the visible light appeared. Thus, excessive IR power leading to charring and other damage to tape can be avoided, and the process can automatically adjust to different media types, window/laser condition, and focal spot variation, isolating reflected power from the particle-glow in a measurement by photodetector 80A.

In conclusion, the above described inventive label printer makes use of a tried and tested, simple, robust carriage mechanism, and an inexpensive robust laser-diode, for minimizing printer cost without sacrificing durability. Added measures for protecting focusing optics, coupled with novel and inventive self-diagnostic and self-adjustment features provide that the printer can be operated by an unskilled user, with minimal or no skilled service events being required.

While a laser-diode as described above is preferred as a source of laser-radiation, clearly other laser-radiation sources, either continuous wave (CW) or pulsed, could be used in the printer without departing from the spirit and scope of the present invention. It is to be anticipated, however, that any such laser would add significantly to the cost of the printer and would likely require periodic skilled service, with attendant down-time of the printer.

The present invention is described above in terms of a preferred and other embodiments. The invention is not limited, however, to the embodiments described and depicted herein. Rather, the invention is limited only by the claims appended hereto.

What is claimed is:

1. Apparatus for printing a laser markable medium, comprising:

a sheet of the medium in a printing plane, the sheet having a width;

a collimating module including a collimating lens;

a focusing module including a turning mirror and a focusing lens, the focusing module being reciprocally translatable along an axis about parallel to the printing plane;

a source of laser-radiation and an optical fiber for transporting the laser-radiation from the source thereof to the collimating module and delivering the laser-radiation from a distal end thereof in a diverging beam to the collimating lens;

the collimating lens arranged to collimate the diverging beam from the optical fiber and direct the collimated beam to the focusing module, the turning mirror directing the collimated beam to the focusing lens and the focusing lens focusing the collimated beam onto the sheet at a focal distance from the focusing lens for printing on the sheet; and a detector housed in a diagnostic module adjacent the sheet in a translation path of the focused beam, the diagnostic module covered by a diagnostic plate including a first and second slots extending therethrough, each of the slots for allowing at least part of the focused beam to enter the diagnostic module for optical access to the detector, wherein the first and second slots have a width and length greater than the beam diameter, with first and second slots being misaligned on opposite sides of the beam travel path and encroach on the beam travel path by less than the beam diameter, and wherein the ratio of the signals generated by the detector as the beam passes the first and second slots corresponds to the amount and direction of misalignment of the beam from the beam travel path and wherein the signals are delivered to an electronic module and wherein the position of the collimating module is adjusted by the electronic module responsive to the alignment signals.

2. The apparatus of claim 1, wherein the diagnostic plate includes a third slot configured to allow the entire focused beam to enter the diagnostic module for providing a signal from the detector representative of the power of the beam.

3. The apparatus of claim 2, wherein the diagnostic plate includes a fourth slot that provides a signal to the electronic module representative of the accuracy of focus of the focused beam.

4. The apparatus of claim 3, wherein the position of the collimating module is adjustable by the electronic module responsive to the focus accuracy signals for keeping the focus accuracy of the focused beam about constant.

5. The apparatus of claim 1, wherein the focal distance becomes greater as the focusing module is translated away from the collimating module and the axis is tilted with respect to the printing plane such that the beam remains focused on the sheet during the translation of the focusing module.

6. The apparatus of claim 1, wherein the source of laser-radiation is a laser-diode.

7. Apparatus for printing a laser markable medium, comprising:

a sheet of the medium in a printing plane, the sheet having a width;

a collimating module including a collimating lens;

a focusing module including a turning mirror and a focusing lens, the focusing module being reciprocally translatable along an axis about parallel to the printing plane;

an elongated window between the focusing module and the printing plane, the window extending beyond the width of the sheet of the medium;

a source of laser-radiation and an optical fiber for transporting the laser-radiation from the source thereof to the collimating module and delivering the laser-radiation from a distal end thereof in a diverging beam to the collimating lens;

the collimating lens arranged to collimate the diverging beam from the optical fiber and direct the collimated beam to the focusing module, the turning mirror directing the collimated beam to the focusing lens and the focusing lens focusing the collimated beam through the window onto the sheet at a focal distance from the focusing lens for printing on the sheet, the window protecting the focusing lens from contamination by by-products of the printing by the focused beam; and a diagnostic module adjacent the sheet and aligned with the portion of the window extending beyond the sheet on the side of the window opposite the focusing lens and in a translation path of the focused beam, the diagnostic module housing a detector and covered by a diagnostic plate including at least one slot extending therethrough, the slot aligned along the translation path, of the slot for allowing at least part of the focused beam to enter the diagnostic module for optical access to the detector as the focused beam translates, thereby providing a corresponding signals representative of the power of the focused beam on the sheet, the power-representative signal being delivered to an electronic module cooperative with the laser-radiation source for maintaining power of the focused beam on the sheet about constant as the window becomes contaminated by the by-products of the printing by the focused beam.

8. The apparatus of claim 7, wherein the diagnostic plate further includes an additional slot arranged so that the detector generates a signal representative of the accuracy of focus of the focused beam.

9. The apparatus of claim 8, wherein the position of the collimating module is adjustable responsive to the focus-accuracy representative signal for keeping the focus accuracy of the focused beam about constant.

10. The apparatus of claim 8, the diagnostic plate further includes a pair of additional slots arranged so that the detector generates signals representative of the alignment of the translation path of the focused beam relative to the sheet-width.

11. The apparatus of claim 10, wherein the position of the collimating module is adjustable by the electronic module responsive to the alignment representative signals for keeping the alignment of the translation path of the focused beam relative to the sheet-width about constant.

12. The apparatus of claim 7, wherein the focal distance becomes greater as the focusing module is translated away from the collimating module and the axis is tilted with respect to the printing plane such that the beam remains focused on the sheet during the translation of the focusing module.

13. The apparatus of claim 7, wherein the source of laser-radiation is a laser-diode.

* * * * *